US006514182B1

(12) United States Patent
Chhloeum

(10) Patent No.: US 6,514,182 B1
(45) Date of Patent: Feb. 4, 2003

(54) DOORFRAME MOUNTABLE EXERCISE SYSTEM

(76) Inventor: Vuthy Chhloeum, 135 Caleb St., Portland, ME (US) 04102

( * ) Notice: Subject to any disclaimer, the term of this patent is extended or adjusted under 35 U.S.C. 154(b) by 0 days.

(21) Appl. No.: 09/528,307

(22) Filed: Mar. 17, 2000

(51) Int. Cl.[7] ..... A63B 21/04; A63B 21/068; A63B 1/00

(52) U.S. Cl. ..... 482/130; 482/96; 482/904; 482/40

(58) Field of Search ..... 482/38–40, 904, 482/907, 129, 123, 130, 102, 103, 99, 95, 96, 124, 141; D21/673, 676, 686, 690–691

(56) References Cited

U.S. PATENT DOCUMENTS

| | | | | | |
|---|---|---|---|---|---|
| 223,668 | A | * | 1/1880 | Duplessis | |
| 3,614,097 | A | | 10/1971 | Blickman | |
| 4,293,127 | A | | 10/1981 | Dudley | |
| D291,340 | S | | 8/1987 | Cooper | |
| 4,747,594 | A | | 5/1988 | Houde | |
| 4,844,448 | A | | 7/1989 | Niznik | |
| 5,013,035 | A | * | 5/1991 | Nathaniel | 272/136 |
| 5,072,934 | A | | 12/1991 | Blanes | |
| 5,080,353 | A | * | 1/1992 | Tench | 272/144 |
| 5,324,243 | A | * | 6/1994 | Wilkinson | 482/92 |
| 5,385,525 | A | * | 1/1995 | Davis | 428/121 |
| 6,110,081 | A | * | 8/2000 | Barrett | 482/121 |

* cited by examiner

*Primary Examiner*—Denise M. Pothier

(57) ABSTRACT

A doorframe mountable exercise system for providing an exercise system that uses a relatively small area of space. The doorframe mountable exercise system includes an elongate member. The elongate member has a first end and a second end. A first rod and a second rod each has an end integrally coupled to and extending away from one of the ends of the elongate member. The first and second rods each have a pair of openings therein. A first and second support bar is removably fastened to opposite sides of a doorframe. A variable weight resistance system includes cables and a plurality of biasing members. Each of the cables extends through the opening of each of the rods. The biasing members are generally resiliently elastic along a longitudinal axis. The biasing member each have a distal end and a proximal end. Each of the distal ends is removably couplable to an end of the cables. A plurality of coupling means removably couples the proximal ends of the biasing members to the first and second rods.

18 Claims, 6 Drawing Sheets

DOORFRAME MOUNTABLE EXERCISE SYSTEM

BACKGROUND OF THE INVENTION

1. Field of the Invention

The present invention relates to exercise apparatuses and more particularly pertains to a new doorframe mountable exercise system for providing an exercise system that uses a relatively small area of space.

2. Description of the Prior Art

The use of exercise apparatuses is known in the prior art. More specifically, exercise apparatuses heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,293,127; and 3,614,097; and 291,340; and 4,844,448; and 4,747,594; and 5,072,934.

While these devices fulfill their respective, particular objectives and requirements, the aforementioned patents do not disclose a new doorframe mountable exercise system. The inventive device includes an elongate member. The elongate member has a first end and a second end. A first rod and a second rod each has an end integrally coupled to and extending away from one of the ends of the elongate member. The first and second rods each have a pair of openings therein. A first and second support bar is removably fastened to opposite sides of a doorframe. A variable weight resistance system includes cables and a plurality of biasing members. Each of the cables extends through the opening of each of the rods. The biasing members are generally resiliently elastic along a longitudinal axis. The biasing member each have a distal end and a proximal end. Each of the distal ends is removably couplable to an end of the cables. A plurality of coupling means removably couples the proximal ends of the biasing members to the first and second rods.

In these respects, the doorframe mountable exercise system according to the present invention substantially departs from the conventional concepts and designs of the prior art, and in so doing provides an apparatus primarily developed for the purpose of providing an exercise system that uses a relatively small area of space.

SUMMARY OF THE INVENTION

In view of the foregoing disadvantages inherent in the known types of exercise apparatuses now present in the prior art, the present invention provides a new doorframe mountable exercise system construction wherein the same can be utilized for providing an exercise system that uses a relatively small area of space.

The general purpose of the present invention, which will be described subsequently in greater detail, is to provide a new doorframe mountable exercise system apparatus and method which has many of the advantages of the exercise apparatuses mentioned heretofore and many novel features that result in a new doorframe mountable exercise system which is not anticipated, rendered obvious, suggested, or even implied by any of the prior art exercise apparatuses, either alone or in any combination thereof.

To attain this, the present invention generally comprises a pair of support bars. Each of the support bars comprises an elongate member. The elongate member has a first end and a second end. A first rod and a second rod each has an end integrally coupled to and extending away from one of the ends of the elongate member. The first and second rods each have a pair of openings therein. A first and second support bar is removably fastened to opposite sides of a doorframe. A variable weight resistance system includes cables and a plurality of biasing members. Each of the cables extends through the opening of each of the rods. The biasing members are generally resiliently elastic along a longitudinal axis. The biasing member each have a distal end and a proximal end. Each of the distal ends is removably couplable to an end of the cables. A plurality of coupling means removably couples the proximal ends of the biasing members to the first and second rods.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new doorframe mountable exercise system apparatus and method which has many of the advantages of the exercise apparatuses mentioned heretofore and many novel features that result in a new doorframe mountable exercise system which is not anticipated, rendered obvious, suggested, or even implied by any of the prior art exercise apparatuses, either alone or in any combination thereof.

It is another object of the present invention to provide a new doorframe mountable exercise system which may be easily and efficiently manufactured and marketed.

It is a further object of the present invention to provide a new doorframe mountable exercise system which is of a durable and reliable construction.

An even further object of the present invention is to provide a new doorframe mountable exercise system which is susceptible of a low cost of manufacture with regard to both materials and labor, and which accordingly is then susceptible of low prices of sale to the consuming public, thereby making such doorframe mountable exercise system economically available to the buying public.

Still yet another object of the present invention is to provide a new doorframe mountable exercise system which provides in the apparatuses and methods of the prior art some of the advantages thereof, while simultaneously overcoming some of the disadvantages normally associated therewith.

Still another object of the present invention is to provide a new doorframe mountable exercise system for providing an exercise system that uses a relatively small area of space.

Yet another object of the present invention is to provide a new doorframe mountable exercise system which includes an elongate member. The elongate member has a first end and a second end. A first rod and a second rod each has an end integrally coupled to and extending away from one of the ends of the elongate member. The first and second rods each have a pair of openings therein. A first and second support bar is removably fastened to opposite sides of a doorframe. A variable weight resistance system includes cables and a plurality of biasing members. Each of the cables extends through the opening of each of the rods. The biasing members are generally resiliently elastic along a longitudinal axis. The biasing member each have a distal end and a proximal end. Each of the distal ends is removably couplable to an end of the cables. A plurality of coupling means removably couples the proximal ends of the biasing members to the first and second rods.

Still yet another object of the present invention is to provide a new doorframe mountable exercise system that does not take up area for storage or take up a large area of a room for use since it is mounted to a doorframe.

Even still another object of the present invention is to provide a new doorframe mountable exercise system that uses interchangeable biasing members, which can offer differing resistance. The amount of resistance may also vary by coupling the biasing members to varying coupling members.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
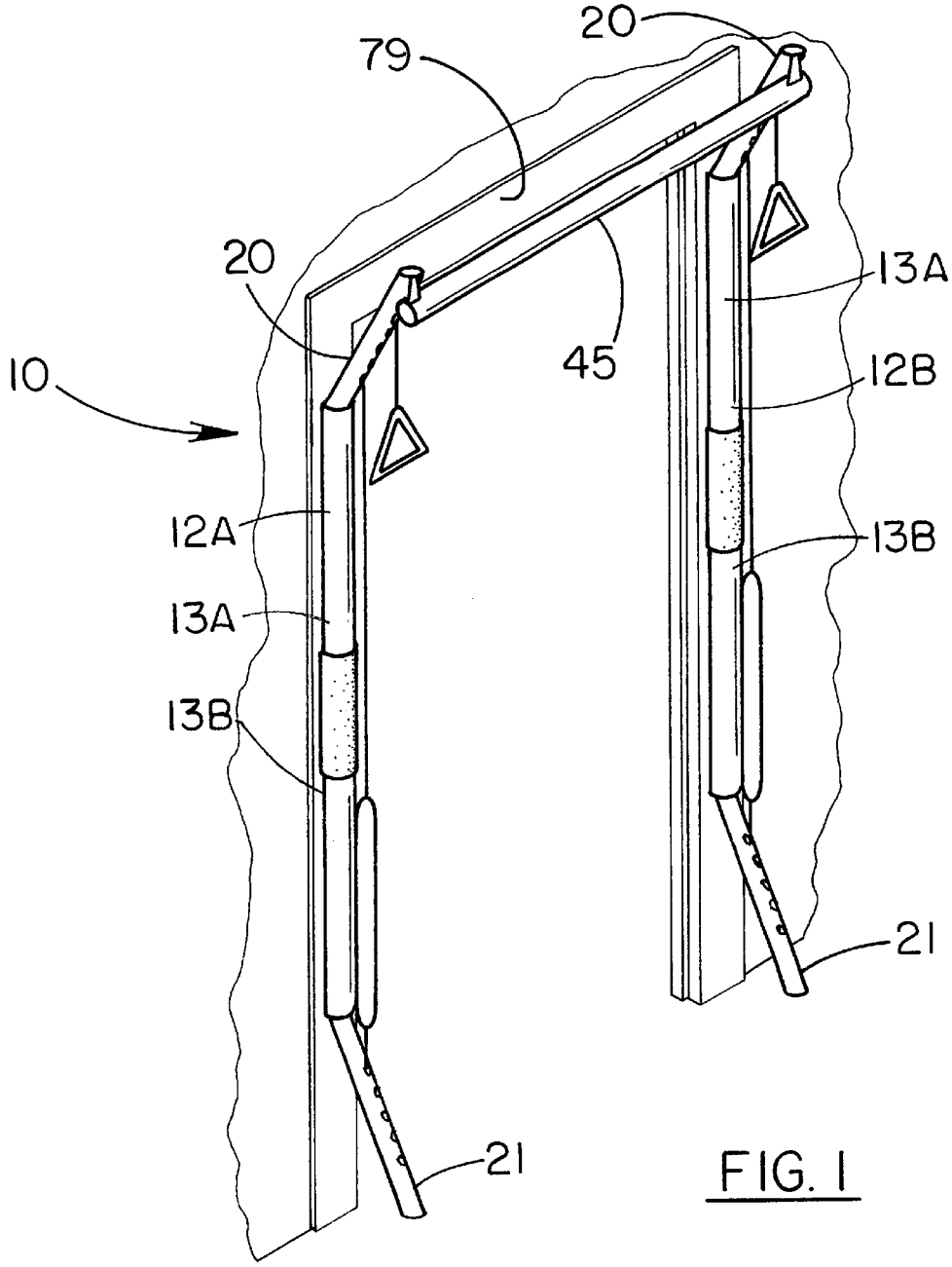
FIG. 1 is a schematic perspective view of a new doorframe mountable exercise system according to the present invention.

With reference now to the drawings, and in particular to FIGS. 1 through 14 thereof, a new doorframe mountable exercise system embodying the principles and concepts of the present invention and generally designated by the reference numeral 10 will be described.

Figure 12:
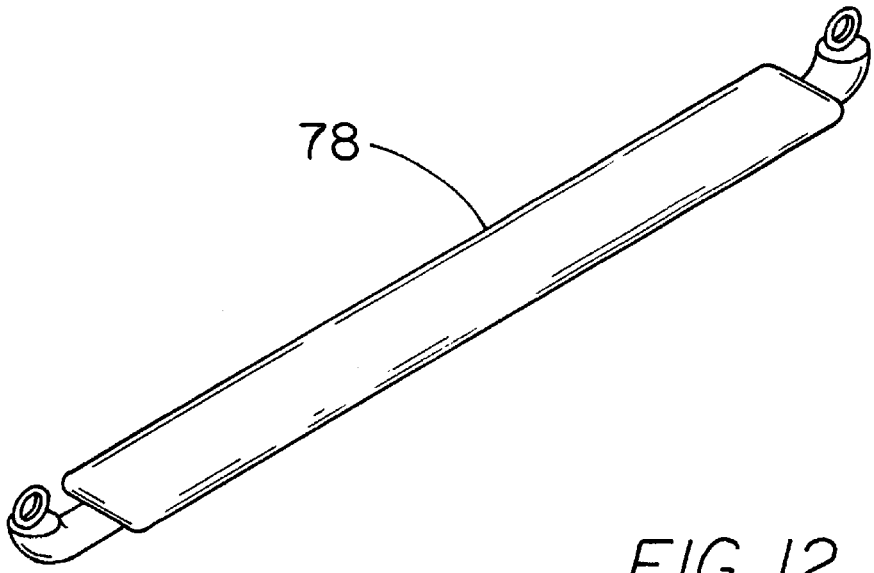
FIG. 12 is a schematic perspective view a leg extension bar of the present invention.
Figure 13:
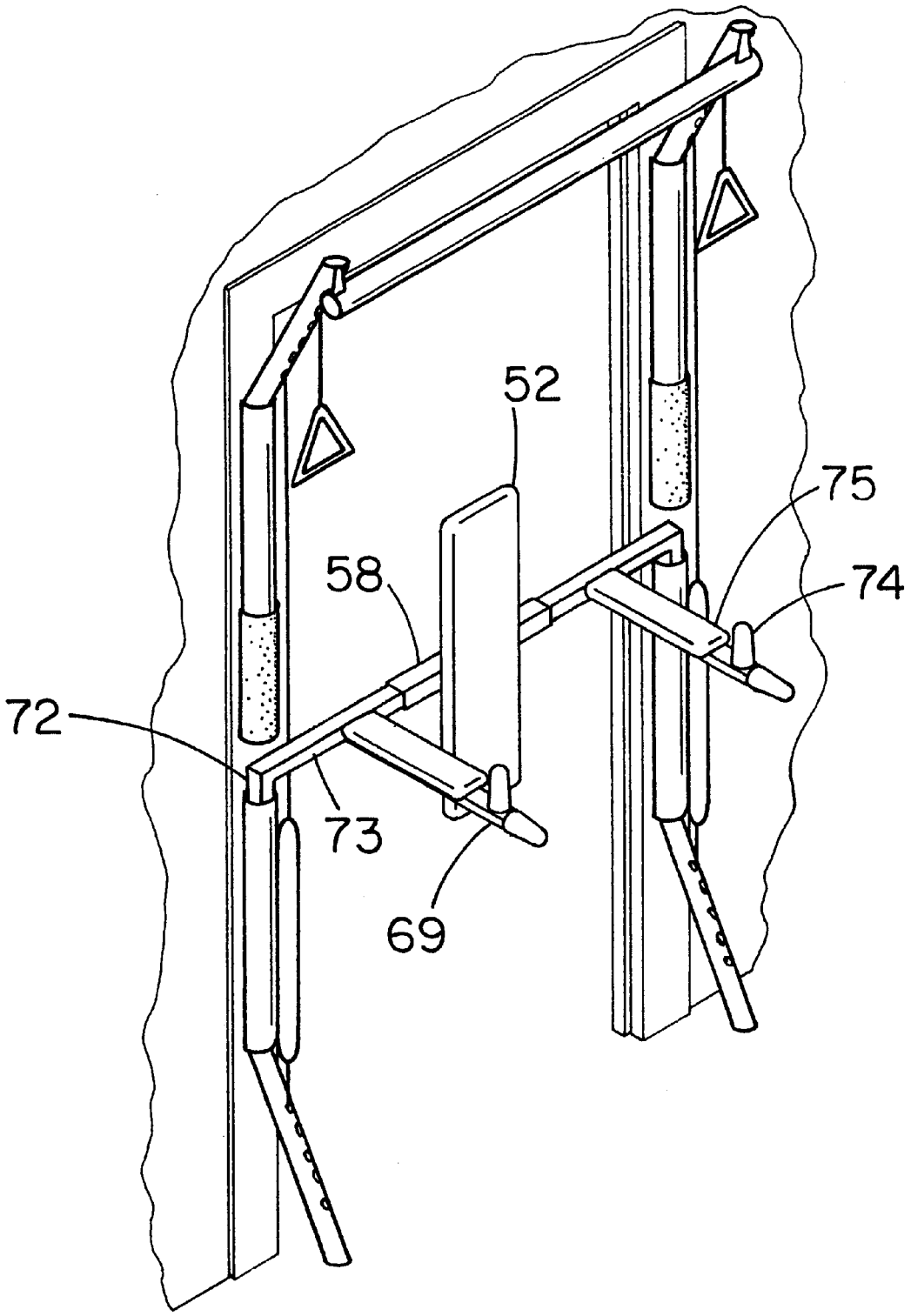
FIG. 13 is a schematic perspective view of the present invention.

As best illustrated in FIGS. 1 through 14, the doorframe mountable exercise system 10 generally comprises a first support assembly 12A for selectively mounting to a first side of the doorframe and a second support assembly 12B for selectively mounting to a second side of the doorframe. Each of the support assemblies includes an upper support member 13A and a lower support member 13B, and each of the upper support members 13A has a first end 14A and a second end 14B and each of the lower support members has a first end 15A and a second end 15B. Each of the support members 13A may include a first portion for positioning against the door frame and a second portion for positioning at an angle with respect to the doorframe. The first portions of the upper and lower support members each have a plurality of apertures 16 extending therethrough. The second portion of the upper support member may be referred to as a first rod 20, and the second portion of the lower support member may be referred to as a second rod 21. Each of the apertures 16 is orientated generally perpendicular to a longitudinal axis of the respective upper and lower support member. A space or break 17 may be located between the upper and lower support members. A cover 18 is adapted to removably cover the break 17 and the apertures 16 in the elongate member 13. The cover has a pad thereon 19. FIG. 13 shows a cover 18 which is split into two pieces to cover both the upper and lower support members on either side of the break.

The first rod 20 and the second rod 21 each have an end that is integrally coupled to one of the ends of the first portion of each of the respective upper and lower support members. When mounted in a doorframe 79, the first rod 20 is positioned adjacent to the top of the doorframe 79. The first 20 and second 21 rods are preferably angled. The first 20 and second 21 rods each forms an angle generally between thirty and sixty degrees with respect to the respective support member 13A, 13B. The first 20 and second 21 rods extend in the same direction away from the support members. The first 20 and second 21 rods each have a pair of openings 22 therein. The openings 22 are spaced and are positioned such that the openings 22 in the first rod 20 are generally opposite of the openings 22 in the second rod 21. The first 20 and second rods 21 are generally hollow.

The support assemblies 12A, 12B are removably fastened to opposite sides of the doorframe 79 such that the rods 20, 21 extend in the same direction away from the doorframe 79. A plurality of fastening means 23 fasten the support assemblies to the doorframe 79. The fastening means 23 are inserted through the apertures 16 in the support members 13A, 13B.

A variable weight resistance system includes a plurality of cables and biasing members. Generally, each of the support assemblies has a first and second cable associated with it.

The first cable 26 extends into one of the openings 22 in the first rod 20 and out of the other of the openings 22 in the first rod 20. The first cable 26 has a first end 27 and a second end 28.

The second cable 30 extends into one of the openings 22 in the second rod 21 and out of the other of the openings 22 in the second rod 21. The second cable 30 has a first end 31 and a second end 32. The first and second ends of the first 26 and second 30 cables have hook portions 34 thereon. The first 20 and second 21 rods have pulley wheels 35 therein such that the first 26 and second 30 cables may travel smoothly through the rods 20, 21 by riding on the pulley wheels 35.

The biasing members 36 are resiliently elastic along a longitudinal axis such that they may be stretched and will spring back. Each of biasing members 36 is elongate and has a distal end 37 and a proximal end 38. Each of the distal 37 and proximal 38 ends has a hook portion 34 integrally coupled thereto. The distal ends 37 are removably couplable to the second ends 28, 32 of the cables 26,30 respectively. Ideally, each of the biasing members 36 comprises a spring. The biasing members 36 may come in a virtually endless variety of lengths, widths and materials such that the resistance may be tailored to the user. Elastomeric bands could also be used in the place of springs. The springs are covered with a cloth 39 to protect the used from being injured by the springs.

A plurality of coupling means 40 removably couple the hook portions 34 on the proximal ends 38 of the biasing members 36 to the first 20 and second 21 rods. Each of the coupling means 40 is an annular member. Each of the first 20 and second 21 rods has three annular members integrally coupled thereto. The annular members are spaced from each other. The annular members on the first 20 and second 21 rods extend toward each other.

A plurality of exercising devices may be included to assist the user in placing resistance against the biasing members 36.

Figure 4:
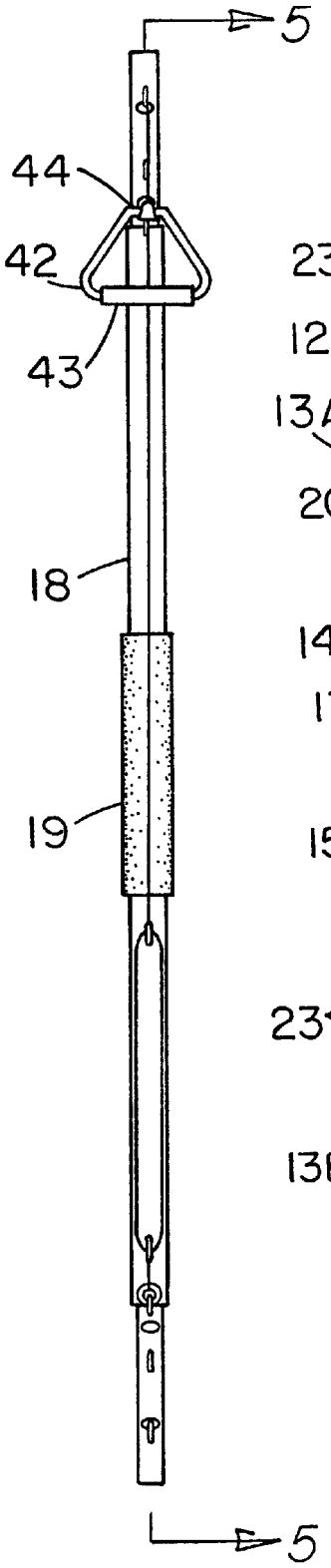
FIG. 4 is a schematic front view of the present invention.
Figure 5:
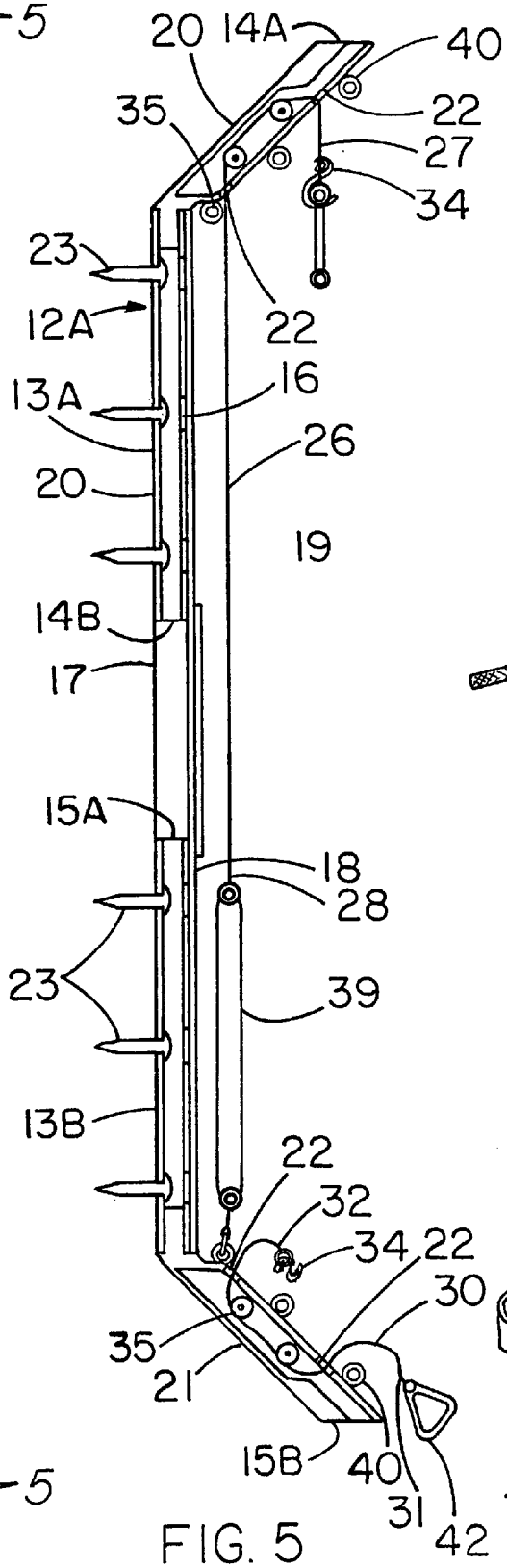
FIG. 5 is a schematic cross-sectional side view taken along line 5—5 of the present invention.
Figure 6:
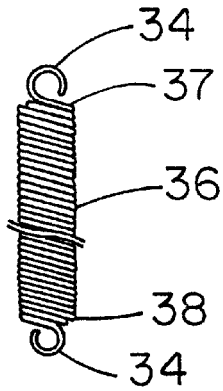
FIG. 6 is a schematic front view of a biasing member of the present invention.

A pair of hand grips 42 are depicted in FIGS. 4 and 5. The hand grips have a base portion 43 and an apex 44 having an annular member thereon. The hand grips 42 are a generally triangular shaped. The annular member on the hand grip is removably couplable to the first ends 27, 31 of the cables 26, 30.

Figure 2:
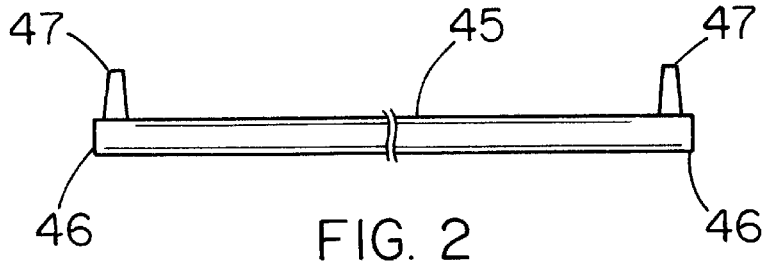
FIG. 2 is a schematic front view of the pull-up bar of the present invention.
Figure 3:
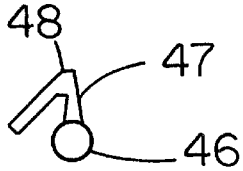
FIG. 3 is a schematic end view of the pull-up bar of the present invention.

A pull-up bar 45 is depicted in FIGS. 1, 2 and 3. The pull-up bar 45 is elongate and has a pair of ends 46. A pair of lugs 47 is coupled to and extends away in the same direction from the pull-up bar 45. Each of the lugs 47 is generally adjacent to one of the ends 46 of the pull-up bar 45. The lugs 47 have a bend 48 therein such that a free end of the lugs 47 may be inserted into an open end of the first rods 20.

Figure 7:
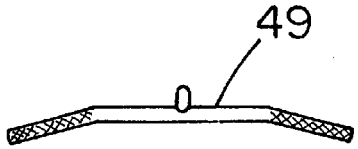
FIG. 7 is a schematic front view of a pull-down bar of the present invention.
Figure 8:
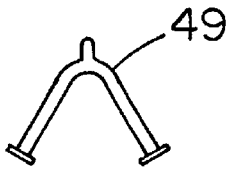
FIG. 8 is a schematic front view of an alternative pull-down bar the present invention.

A pull-down bar 49 is depicted in FIG. 7. The pull-down bar is elongate and has a length greater than two feet. The pull-down bar 49 has a central portion having a annular member thereon for removably coupling to the first ends 27, 31 of the cables 26, 30. FIG. 8 is a modified pull-down bar which is V-shaped.

Figure 9:
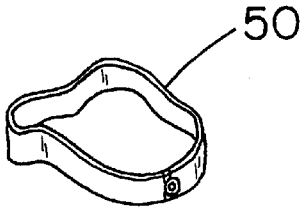
FIG. 9 is a schematic perspective view of a belt of the present invention.

FIG. 9 is a belt 50 which may be worn and coupled to either the first 26 or second 30 cable for doing various exercises.

Figure 10:
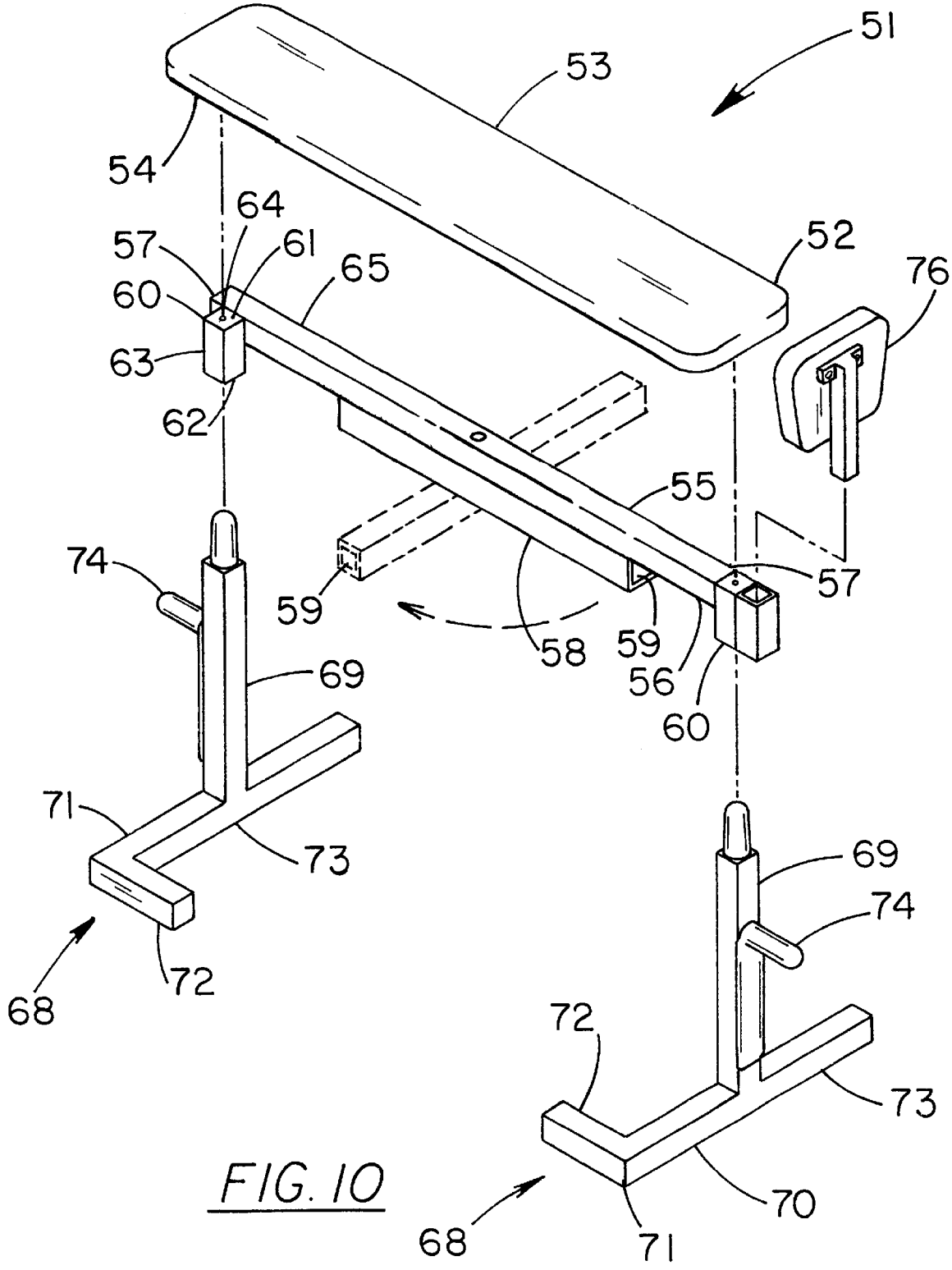
FIG. 10 is a schematic perspective view a bench device of the present invention.
Figure 11:
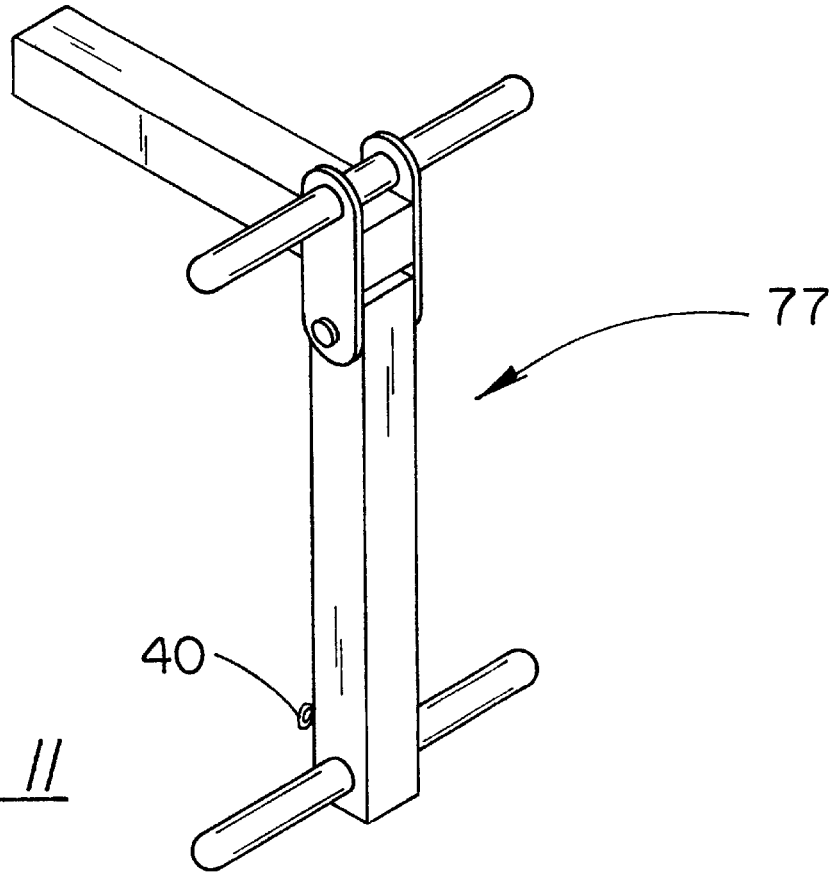
FIG. 11 is a schematic perspective view of a leg lift device of the present invention.
Figure 14:
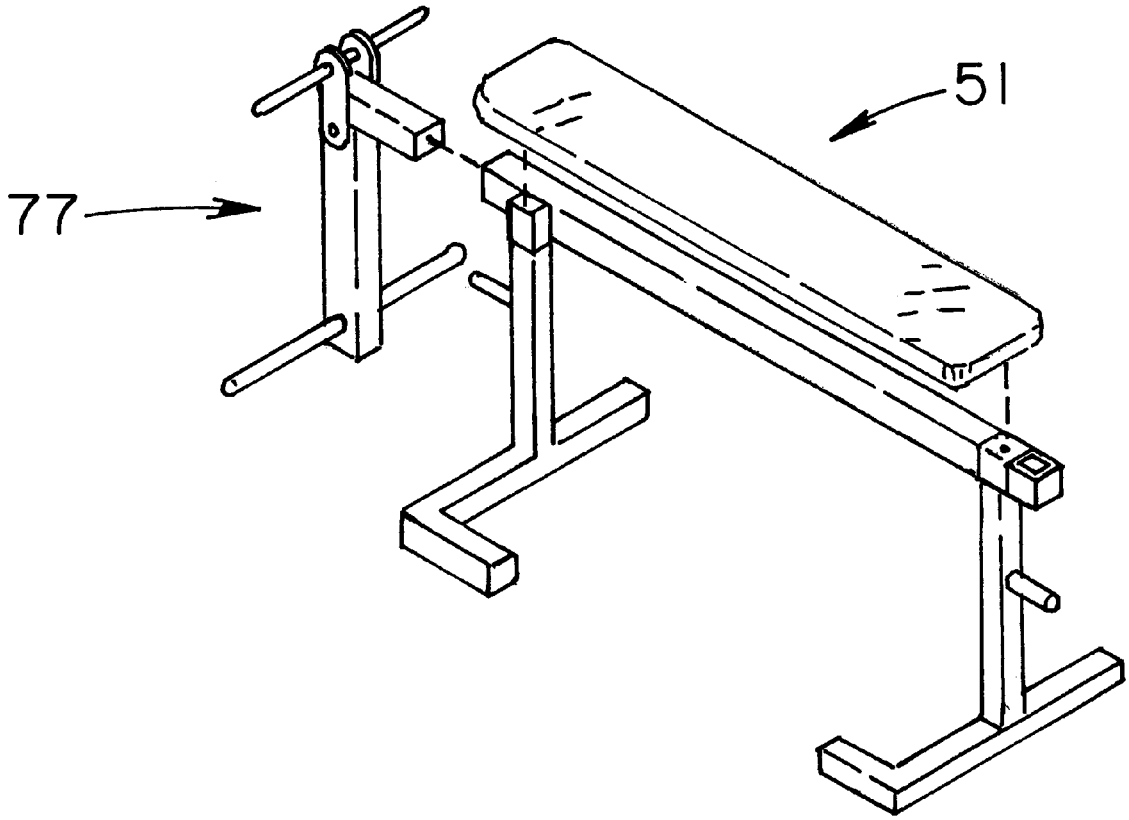
FIG. 14 is a schematic perspective view of the present invention.

A bench device 51 is included for used against the lower support members 13B as shown in FIG. 13 or to be used alone as in FIGS. 10 and 14.

The bench device 51 has platform member 52. The platform member 52 has a top side 53 and a bottom side 54. The top side 53 generally has a rectangular shape. The bottom side 54 has a pair of spaced mounting pins therein. The mounting pins are not shown but are necessary as will soon be readily apparent. The top side 53 is padded for comfort of the user.

The platform member is rested against a first bar 65. The first bar 65 is elongate and has a top side 55 and a bottom side 56. The first bar 54 has a par of opposite ends 57.

A second bar 58 has a middle section which is rotatably coupled to the bottom side 56 of the first bar 65. The second bar 56 has a pair of open ends 59.

A pair of female couplers 60 each has a top side 61, a bottom side 62 and a peripheral wall 63 therebetween. The peripheral walls 63 of each of the female couplers 60 are integrally coupled to the first bar 54. Each of the female couplers 60 is positioned generally adjacent to one of the ends 57 of the first bar 65. The top sides 61 of the female couplers 60 have bores 64 therein adapted for receiving the pins from the platform member 52 such that the platform member 52 may be removably attached to the first bar 65. The bottom sides 62 of the female couplers 60 are open.

A pair of legs 68 supports the first bar 65. Each of the legs 68 has an upstanding member 69 and a base bar 70. The upstanding members 69 are integrally coupled to and extend upwardly away from the base bars 70. Each of the upstanding members 69 has a free end adapted for insertion into the bottom sides 62 of the female couplers 60 as shown in FIG. 10. Each of the base bars 70 has a bend 71 therein such that the base bars 70 are generally L-shaped. Each of the base bars 70 has a short portion 72 and a long portion 73. The short portions 72 extend toward each other when the free ends of the upstanding members 69 are in the female couplers 60. The short portions 72 may be inserted in the breaks 17 between the upper 13A and lower 13B support members and slid into the first end 15 A of the lower support member 13B. The long portions may be inserted into opposite open ends 59 of the second bar 58 as shown in FIG. 13. The upstanding members 69 each have a protruding member 74 thereon. The protruding members 74 extend upward when the short portions 72 are inserted into the breaks 17. Adjacent to the protruding members 74 are pads 75 for the user. The user may use the configuration in FIG. 13 for leg lifts.

A seat portion 76 may be added to the bench. The seat portion has male bracket thereon for insertion into a female bracket on the first bar 65. The seat portion 76 may be used as a pad for biceps and triceps curls. Also, a leg lift system 77 comprising a pair of hingedly coupled elongate members may have one of the elongate members inserted into an open end of the first bar 65. An annular member on the other of the elongate members may be coupled to the second cables. FIG. 12 shows a leg extension pad 78 that has two ends, which may be coupled to cables.

In use, the user couples one end of a biasing member 36 onto one of the annular members 40. The other end of the biasing member 36 is coupled to the cable 26, 30 which the user would like to use. If the user uses the second cables 30, the biasing member 36 would be connected to the annular members 40 on the first rod 20. With the bench member 52 placed in the upright position as shown in FIG. 13, the user may do various chest exercises with their back to the bench member 52 or they may do leg lifts. The pull-up bar 45 may be inserted for doing pull-ups. This method allows the user to effectively execute primary exercises.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exercising system for selectively mounting to a doorframe, said system comprising:

a first support assembly for selectively mounting to a first side of the doorframe and a second support assembly for selectively mounting to a second side of the doorframe;

each of said support assemblies including an upper support member and a lower support member, said upper and lower support members each having a first end and a second end;

said upper and lower support members each comprising a first portion and a second portion, each of said portions of said support members comprising an elongate tubular member, each of said first portions having a plurality of apertures therein for receiving a plurality of fastening members, said second portions being angled with respect to an associated one of said first portions, said second portions each forming an angle generally between thirty and sixty degrees with respect to a longitudinal axis of each of said first portions such that said second ends of said upper and lower support members are positioned away from the doorframe and are generally aligned when each of said first portions are mounted on the doorframe in generally the same orientation, each of said second portions having a pair of holes therein;

a plurality of cables having a first end and a second end, said plurality of cables comprising an upper pair of cables and a lower pair of cables, each of said ends of said cables having a hook portion thereon;

a plurality of elongate biasing members having a first end and a second end; and a plurality of coupling members being mounted on and positioned along a length of each of said second portions of said upper and lower support members, each of said coupling members being located generally adjacent to said holes in said second portions.

2. The exercising system as in claim 1, further comprising: a bench device, said bench device comprising:

a platform member, said platform member having a top side and a bottom side, said top side generally having a rectangular shape, said bottom side having a pair of spaced mounting pins therein, said top side being padded;

a first bar for resting said platform member, said first bar being elongate and having a top side and a bottom side, said first bar having a par of opposite ends, said first bar having a pair of female couplers thereon adapted for receiving said pins from said platform member;

a second bar, said second bar having a middle section being rotatably coupled to said bottom side of said first bar, said second bar having a pair of open ends; and a pair of legs, each of said legs having an upstanding member and a base bar, wherein said upstanding members are integrally coupled to and extending upwardly away from said base bars, each of said upstanding members having a free end adapted for insertion into said female couplers, each of said base bars having a bend therein such that said base bars are generally L-shaped, wherein a first portion of said base bars may be inserted into said first end of said lower support member and a second portion of said base bars may be inserted in an end of said second bar.

3. The exercising system as in claim 1, further comprising each of said holes of said second portions being positioned in a manner such that said holes in said second portion of said upper support member are generally aligned with said holes in said second portion of said lower support member when each of said first portions are mounted on the doorframe in generally the same orientation.

4. The exercising system as in claim 1, further comprising a pair of hand grips, said hand grips having a base portion and an apex having an annular member thereon, said hand grips being generally triangular shaped, said annular member on said hand grip being removably couplable to said first ends of said cables.

5. The exercising system as in claim 1, further comprising: a pull-up bar, said pull-up bar being elongate and having a pair of outer ends, a pair of lugs being coupled to and extending away in the same direction from said pull-up bar, each of said lugs being generally adjacent to one of said ends of said pull-up bar, said lugs having a bend therein such that a free end of said lugs may be inserted into said second ends of said second portion of said upper and lower support members.

6. The exercising system as set forth in claim 1, further comprising said first and second support assemblies each having a space located between said first ends of each of said first portions of each of said upper and lower support members, each of said upper and lower support members being selectively mountable to the doorframe in a manner such that said space is defined.

7. The exercising system as set forth in claim 1, further comprising wherein said upper pair of cables extends into a first one of said openings in said second portion of said upper support member and out of a second one of said openings; and wherein said lower pair of cables extends into a first one of said openings in said second portion of said lower support member and out of a second one of said openings.

8. The exercising system as set forth in claim 1, further comprising each of said cables being movably positionable through said second portions of said upper and lower support members, wherein said second portions of said upper and lower support members have pulley wheels therein to facilitate travel of said cables through each of said second portions.

9. The exercising system as set forth in claim 1, further comprising each of said ends of said biasing members having a hook portion for selectively coupling to one of said ends of each of said cables and said coupling members, each of said biasing members comprising a spring.

10. The exercising system as set forth in claim 1, further comprising wherein when in a first configuration said second end of each of said biasing members are attached to said coupling members of said second portion of said lower support member and said first end of each of said biasing members are attached to said second ends of said upper pair of said cables; and wherein when in a second configuration said first end of each of said biasing members are attached to said coupling members of said second portion of said upper support member and said second end of each of said biasing members are attached to said second ends of said lower pair of said cables.

11. The exercising system as set forth in claim 1, further comprising a lift assembly for selectively coupling to said lower support members of said first and second support assemblies, said lift assembly comprising a pair of lift members and a platform member for selectively coupling said lift members together.

12. The exercising system as set forth in claim 11, further comprising each of said lift members having an upstanding member and a base bar, wherein said upstanding members are integrally coupled to and extend away from said base bars in a substantially perpendicular manner; and each of said base bars having a bend therein such that said base bars having a short portion and a long portion.

13. The exercising system as set forth in claim 12, further comprising said upstanding members each having a pair of protruding members thereon for gripping onto by hands of a user, a pad being mounted on an upper side of each of said upstanding members.

14. The exercising system as set forth in claim 12, further comprising said platform member having a connecting bar assembly being mountable to said back side of said platform member, said connecting bar assembly comprising a first bar and second bar, each of said bars comprising an elongate tubular member, said first bar having a length generally equal to a length of said platform member, said first bar being mountable to said back side of said platform member, a center part of said second bar being rotatably coupled to a middle part of said first bar such that said second bar is rotatable into an orientation generally perpendicular to said platform member, said second bar having a length less than the length of said first bar, said second bar having a pair of open ends for slidably receiving said long portions of said lift members such that a width of said lift assembly is variable.

15. The exercising system as set forth in claim 12, further comprising each of said short portions of said base bars of said lift members being releasably insertable into each of said first ends of said lower support member such that said lift assembly is selectively mountable to said lower support assemblies when each of said lift members are coupled to said platform member.

16. The exercising system as set forth in claim 12, wherein each of said upstanding members of said lift members extend outward when said lift assembly is mounted to said first and second lower support assemblies to allow a user to perform a variety of exercises.

17. The exercising system as set forth in claim 11, further comprising said platform member having a front side and a back side, said front side being padded, said platform member having a generally rectangular shape.

18. An exercising system for selectively mounting to a doorframe, said system comprising:

a first support assembly for selectively mounting to a first side of the doorframe and a second support assembly for selectively mounting to a second side of the doorframe;

each of said support assemblies including an upper support member and a lower support member, said upper and lower support members each having a first end and a second end, said upper and lower support members each comprising a first portion and a second portion, each of said second portions having a pair of holes therein;

a plurality of coupling members being mounted on and positioned along a length of each of said second portions of said upper and lower support members, each of said coupling members being located generally adjacent to said holes in said second portions;

a plurality of cables having a first end and a second end, said plurality of cables comprising an upper pair of cables and a lower pair of cables;

wherein said upper pair of cables extends into a first one of said holes in said second portion of said upper support member and out of a second one of said holes;

wherein said lower pair of cables extends into a first one of said holes in said second portion of said lower support member and out of a second one of said holes;

a plurality of elongate biasing members having a first end and a second end, each of said ends of said biasing members having a hook portion for selectively coupling to one of said ends of each of said cables and said coupling members, each of said biasing members comprising a spring;

wherein said second portions of said upper and lower support members have pulley wheels therein to facilitate travel of said cables through each of said second portions;

a plurality of exercising devices, said exercising devices comprising:

a pair of hand grips, said hand grips having a base portion and an apex having an annular member thereon, said hand grips being generally triangular shaped, said annular member on said hand grip being removably couplable to said first ends of said cables;

a pull-up bar, said pull-up bar being elongate and having a pair of outer ends, a pair of lugs being coupled to and extending away in the same direction from said pull-up bar, each of said lugs being generally adjacent to one of said ends of said pull-up bar, said lugs having a bend therein such that a free end of said lugs may be inserted into said second ends of said second portion of said upper support members;

a pull-down bar, said pull-down bar being elongate, said pull-down bar having a length greater than two feet, said pull-down bar having a central portion having a annular member thereon for removably coupling to said first ends of said cables;

a lift assembly for selectively coupling to said lower support members of said first and second support assemblies, said lift assembly comprising a pair of lift members and a platform member for selectively coupling said lift members together;

each of said lift members having an upstanding member and a base bar, wherein said upstanding members are integrally coupled to and extend away from said base bars in a substantially perpendicular manner;

each of said base bars having a bend therein such that said base bars having a short portion and a long portion;

said upstanding members each having a pair of protruding members thereon for gripping onto by hands of a user, a pad being mounted on an upper side of each of said upstanding members;

said platform member having a front side and a back side, said front side being padded, said platform member having a generally rectangular shape;

said platform member having a connecting bar being fixedly coupled to said back side and being oriented generally perpendicular to said platform member, said connecting bar having a pair of open ends for slidably receiving said long portions of said lift members such that a width of said lift assembly is variable;

each of said short portions of said lift members being releasably insertable into said first ends of said lower support member such that said lift assembly is selectively mountable to said lower support assemblies when each of said lift members are coupled to said platform member; and wherein each of said upstanding members of said lift members extend outward when said lift assembly is mounted to said first and second lower support assemblies to allow a user to perform a variety of exercises.

* * * * *